US006997376B1

(12) United States Patent
Collins

(10) Patent No.: US 6,997,376 B1
(45) Date of Patent: Feb. 14, 2006

(54) ANTI-TETHER DEVICE

(75) Inventor: James D. Collins, Jenison, MI (US)

(73) Assignee: Rowe International Corporation, Grand Rapids, MI (US)

( * ) Notice: Subject to any disclaimer, the term of this patent is extended or adjusted under 35 U.S.C. 154(b) by 171 days.

(21) Appl. No.: 10/605,690

(22) Filed: Oct. 17, 2003

(51) Int. Cl.
*G06F 17/60* (2006.01)

(52) U.S. Cl. ..... 235/379; 235/475; 235/479

(58) Field of Classification Search ..... 235/379, 235/479, 485
See application file for complete search history.

(56) References Cited

U.S. PATENT DOCUMENTS 3,715,031 A 2/1973 Okkonen ..... 209/75
4,348,656 A 9/1982 Gorgone et al. ..... 340/146.3
4,513,439 A 4/1985 Gorgone et al. ..... 382/7
4,754,126 A * 6/1988 Caldwell ..... 235/379
5,760,380 A * 6/1998 May ..... 235/379
6,668,998 B1 12/2003 Mosteller et al. ..... 194/203

* cited by examiner

*Primary Examiner*—Diane I. Lee
*Assistant Examiner*—Seung H Lee
(74) *Attorney, Agent, or Firm*—Dickstein Shapiro Morin & Oshinsky LLP

(57) ABSTRACT

An anti-tether device used in vending machines to prevent retrieval of paper currency that is attached to a tether. The anti-tether device includes a slotted disk aligned with the paper currency path and is caused to rotate after paper currency passes through the slot. A tether attached to the paper currency will inhibit the motion of the disk. If the vending machine control system determines that the disk did not rotate completely or did not rotate within a predetermined time limit, the vending machine will not dispense a product or service and may send an external signal. Alternatively, if a product or service is dispensed despite the presence of a tether, the paper currency will not be retrievable, as the tether will be mechanically wound around a shaft of the anti-tether apparatus.

34 Claims, 5 Drawing Sheets

ANTI-TETHER DEVICE

BACKGROUND OF INVENTION

The present invention is directed towards an apparatus and method to prevent the retrieval of paper currency that is inserted into a vending machine adapted to accept paper currency in exchange for goods or services.

The popularity and presence of vending machines in the self-service market is constantly increasing. Vending machines are used, for example, to dispense change, food, drinks, and other goods, as well as to initiate services such as at a laundromat or car wash. As such machines are meant to provide self-service, they are often located in environments that are unattended by representatives of the owners of the machines. These unattended vending machines are an inviting target for those individuals who would seek to cheat the machines into dispensing their associated goods or services without properly paying for them.

One method that is employed in this type of theft is to attach a tether or string to a valid currency. In general, vending machines include mechanisms to transport paper currency along a paper currency path, validate the currency, and then store the currency. In this theft method, a tethered currency is inserted into a vending machine and as the paper currency travels along the currency path and into the storage mechanism, the tether trails behind and remains in the currency path and extends outside the vending machine. After the machine has dispensed the good or service, the tether is used to remove the valid currency from the machine. The prevention of theft by this method of removing valid paper currency from a vending machine is the goal of this invention.

Different anti-tether devices exist in the prior art. One such device is disclosed in U.S. Pat. No. 4,348,656 issued to Gorgone et al. This device involves a barrel located along the path taken by the paper currency. After the paper currency passes through the barrel, the barrel is caused to rotate about an axis perpendicular to the direction of the paper currency path. The barrel is prevented from being rotated in a reverse direction when the tether is pulled by mechanical means such as gears or needle bearings.

However, the barrel device suffers from several deficiencies. The mechanical barrel substantially increases the path along which the paper currency must travel, thereby creating greater space requirements in an already constrained environment within the vending machine. Further, the barrel requires additional mechanical anti-rotation equipment that adds expense and can be subject to malfunction. The device is also difficult to install as an after-market addition to existing vending machines because of the required increase in the length of the currency path.

SUMMARY OF INVENTION

An anti-tether apparatus according to an aspect of the invention, for use in a vending machine that dispenses a good or service in exchange for paper currency, includes a generally circular and rotatable disk with a slot. Paper currency that is accepted by a vending machine is passed through the slot and the disk is then rotated on an axis substantially parallel to the direction in which the paper currency passed through the slot. The invention provides a method of sensing the presence of a tether located in the slot and, when detected, the vending machine will not dispense a product or service. Further, if a product or service is dispensed despite the presence of a tether, the invention mechanically prevents the tethered paper currency from being withdrawn. The invention accomplishes these functions consistently and without the need for increased paper currency path length and without the need for additional mechanical components to prevent reverse rotation.

The anti-tether apparatus is located between a paper currency acceptor that receives paper currency inserted by a customer, and a paper currency stacker that stores the received paper currency. A paper currency validator is located within the paper currency acceptor and establishes the authenticity of the inserted paper currency. The vending machine also includes electronic controls that monitor the anti-tether apparatus and initiate the dispensing of a product or service if a tether attached to the paper currency is not detected. The anti-tether apparatus can be used on newly made vending machines or can be an add-on to existing vending machines.

DETAILED DESCRIPTION

Figure 1:
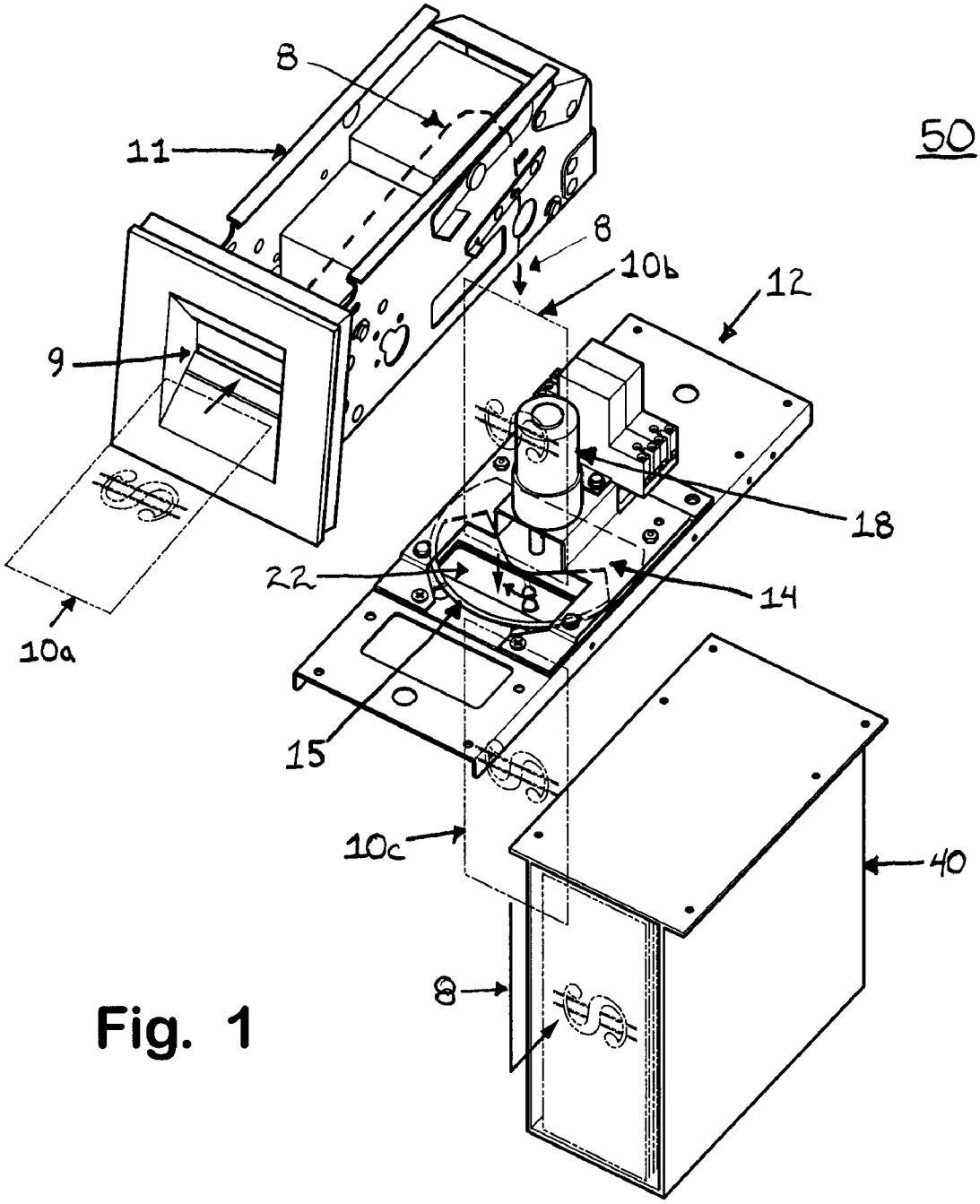
FIG. 1 is a perspective view of paper currency handling components of a vending machine in their assembly orientation.
Figure 7:
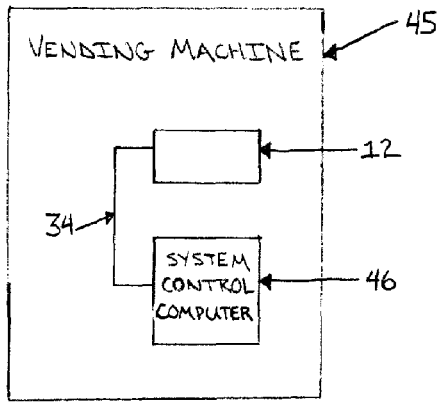
FIG. 7 is a vending machine embodying the present invention and system control computer.

Referring now specifically to the drawings and the illustrative embodiments depicted therein, an anti-tether apparatus 12 is one of the paper currency handling components, identified by reference numeral 50 (FIG. 1), of a vending machine (FIG. 7). Anti-tether apparatus 12 is located between paper currency acceptor 11 and paper currency stacker 40. The paper currency handling components 50 may be used in any vending machine apparatus 45 adapted to perform a vend function such as the dispensing of change, dispensing of a product or dispensing of a service in exchange for valid paper currency. Such vending machines are used, for example, to dispense coins, tokens, food, drinks, and other goods, as well as to initiate services such as at a laundromat or car wash. Paper currency 10*a*, 10*b*, and 10*c* travel along paper currency path 8 of paper currency handling components 50. A portion of paper currency path 8 is internal to paper currency acceptor 11 and is shown as a dashed line in FIG. 1. Paper currency acceptor 11 includes currency insertion opening 9 and a paper currency validator (not shown) that determines the authenticity of paper currency 10*a*. Paper currency acceptor 11 and paper currency validators are commercially available and marketed by Rowe International, Inc. of Grand Rapids, Mich. as Model No. BA50. Further, paper currency stacker 40 collects, stacks, and stores the accepted paper currency 10*c* and is also commercially available from Rowe International, Inc.

Figure 2:
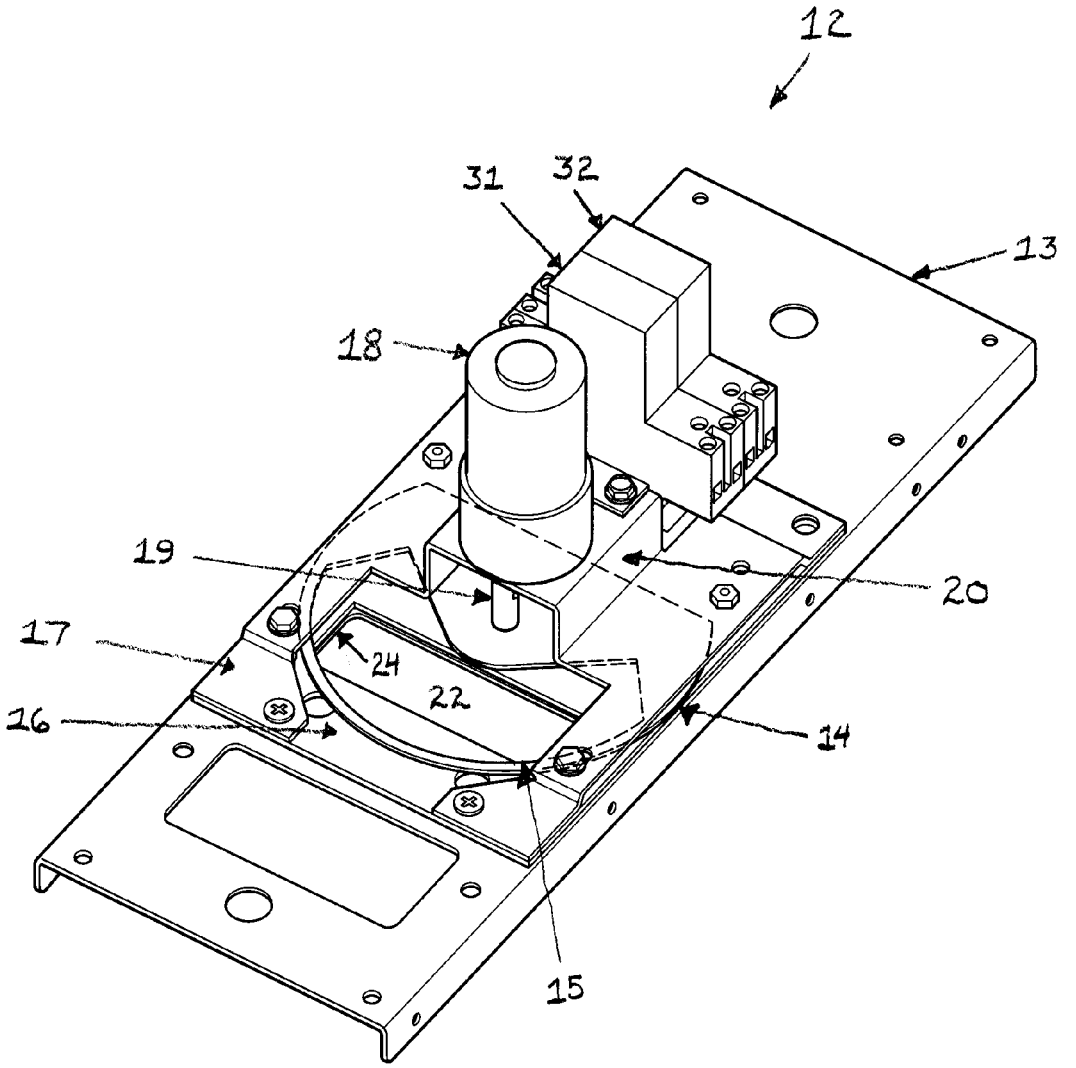
FIG. 2 is a perspective view of an anti-tether apparatus.
Figure 5:
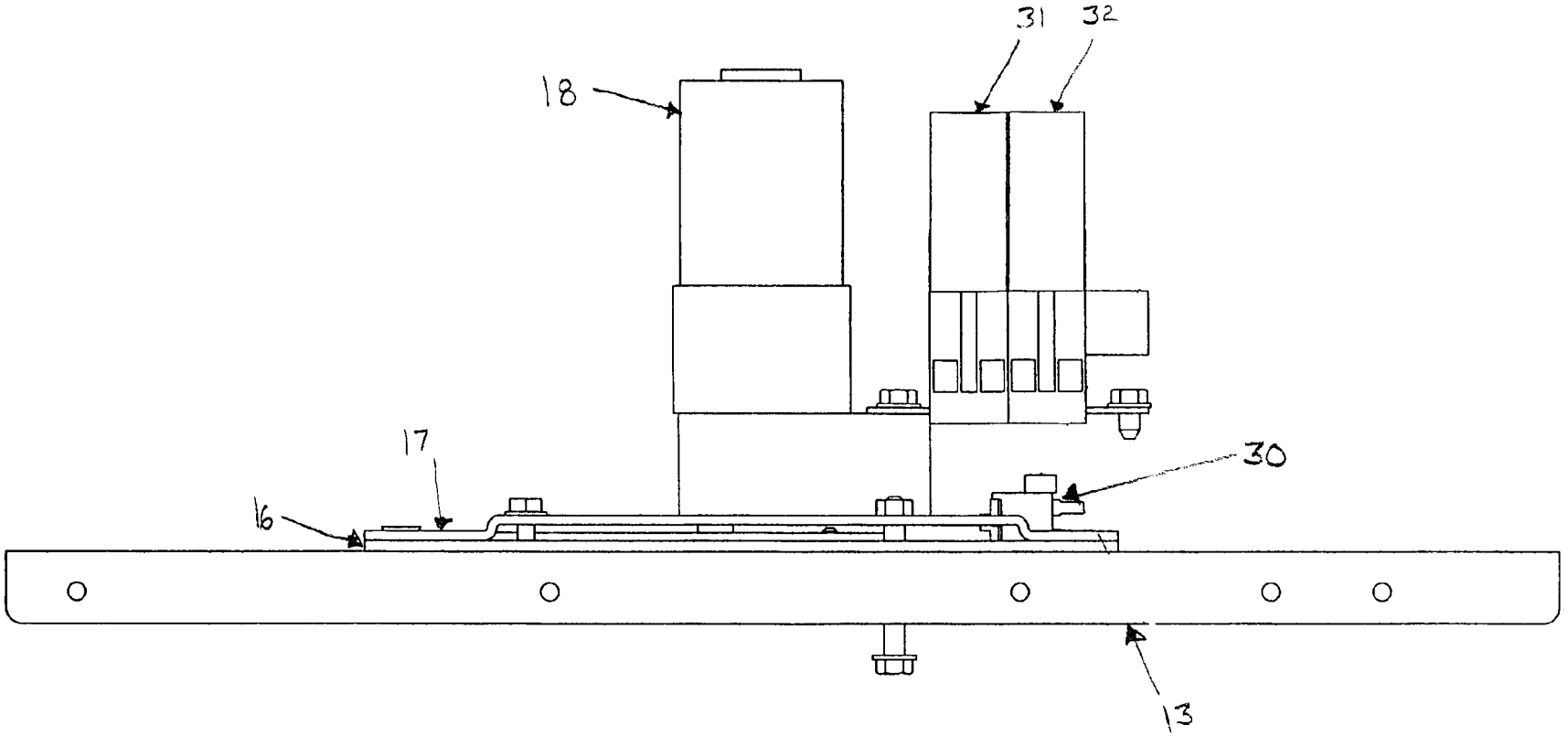
FIG. 5 is a side view of the anti-tether apparatus of FIG. 3.

As seen in FIG. 2, anti-tether apparatus 12 includes rotatable disk 14 with slot 15 and is located between back plate 16 and front plate 17. Disk 14 is selectively rotated by motor 18, which has a low torque output such that any impediment to rotation of disk 14 will tend to cause motor 18 to stall. As can be seen in FIG. 5, anti-tether apparatus 12 further includes disk position sensor 30, whereby the position of disk 14 and the duration of rotation can be monitored by the system control computer 46 of the vending machine 45, discussed below.

Figure 3:
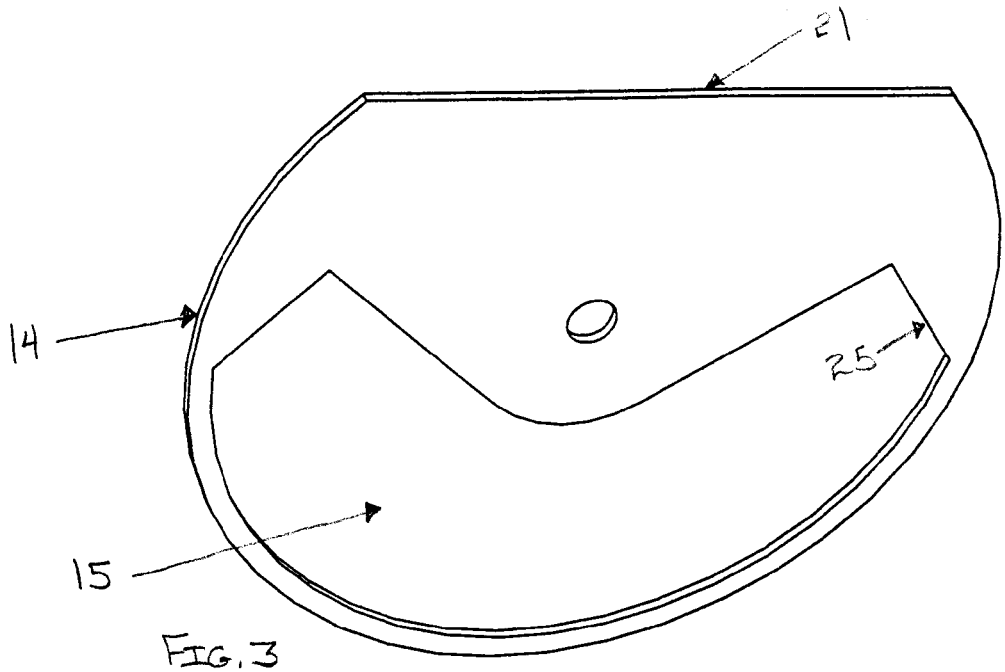
FIG. 3 is a perspective view of a slotted disk of an anti-tether apparatus.
Figure 4:
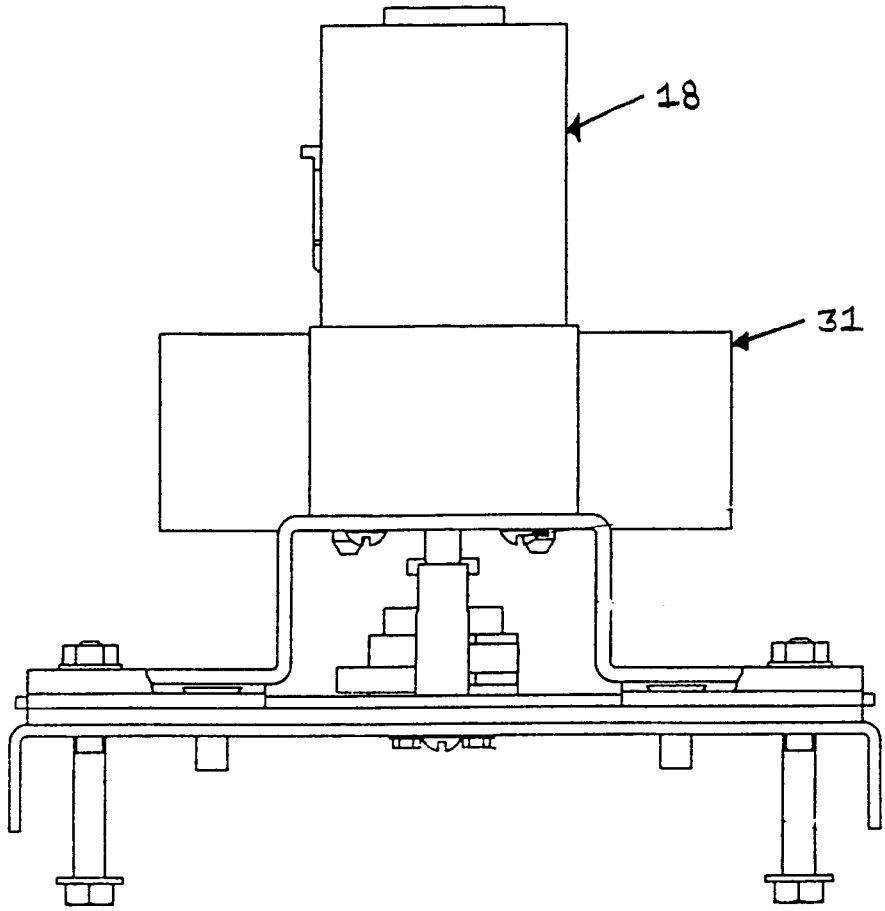
FIG. 4 is a front view of the anti-tether apparatus of FIG. 3.

The geometry of disk 14 can be seen in FIG. 3. Slot 15 is bounded on all sides such that any item passing into slot 15 cannot exit on a path radial to disk 14. Rather, any item passing into slot 15 must exit by continuing on a path that is generally parallel to the axis of rotation of disk 14. Slot 15, when disk 14 is caused to rotate in a clockwise direction, includes trailing edge 25. However, disk 14 may be rotated either clockwise or counter-clockwise and achieve the same result due to the bilateral symmetry of disk 14. Additionally, disk 14 has straight edge 21 such that sensor 30 (FIG. 5) is able to detect the relative position of slot 15 when motor 18 rotates disk 14. Although the preferred embodiment discloses a bounded slot 15, this is not meant to limit the invention, as other geometries that cause material to be generally contained within slot 15 will function to meet this aspect of the invention.

In operation, a paper currency 10*a* is fed into currency insertion opening 9 of paper currency acceptor 11, typically in a generally horizontal orientation. The paper currency 10*a* is then movably advanced along path 8 to an internal paper currency validator, which determines the authenticity of the paper currency 10*a*. If the paper currency 10*a* is found to be invalid, it is ejected out currency insertion opening 9. If the paper currency 10*a* is determined to be valid, the paper currency 10*a* is movably discharged out of the paper currency acceptor 11. The paper currency 10*b* then passes in a substantially perpendicular orientation through slot 15 of rotatable disk 14, which is normally aligned with openings 22 and shall be referred to as the home position. The paper currency 10*c* then enters paper currency stacker 40. If a tether is attached to paper currency 10*c*, it will remain in the openings 22 of front plate 17, back plate 16, and frame 13 and the slot 15 of disk 14 when paper currency 10*c* passes into currency stacker 40. Further, the tether will be located in the paper currency path 8 of paper currency acceptor 11 and extend out of currency insertion opening 9.

After a brief delay from when the paper currency 10*b* exits currency acceptor 11, disk 14 is caused to rotate by motor 18. If a tether is not attached to paper currency 10*c*, disk 14 will rotate freely. A vend function will be initiated upon completion of at least one full revolution of disk 14 within a predetermined time limit as monitored by the vending machine system control computer 46. The vending machine controls are described below.

If a tether is attached to paper currency 10*c*, the tether will be located in openings 22 and slot 15 when paper currency 10*c* enters currency stacker 40. When disk 14 is caused to rotate in a clockwise direction the tether will create a shearing resistance between slot 15 and trailing edge 25 of disk 14 and non-moving edges 24 of frame 13 and back plate 16. As motor 18 is of low torque, this shearing resistance will tend to stall motor 18. Alternatively, because of the tether, if disk 14 does make one complete revolution, it should do so outside of the predetermined time limit of the control system. The vending machine apparatus 45 will not perform the vend function if motor 18 stalls or disk 14 makes a complete revolution outside of the predetermined time limit. Further, upon motor 18 stalling or disk 14 rotating outside of the predetermined time limit, the vending machine apparatus 45 may be adapted to send an external signal. Such external signal can be any or all of contacting service personnel, emitting an audible alarm, or notifying law enforcement personnel.

If disk 14 makes at least one revolution within the predetermined time limit despite the presence of a tether attached to currency 10*c* the vend function will be initiated. Such a result is possible if the tether located in openings 22 and slot 15 does not create sufficient shearing resistance to slow the rotation or stall motor 18 when disk 14 is caused to rotate. However, bounded slot 15 and trailing edge 25 will cause the tether to be forced into the area defined by elevated portion 20 of front plate 17. When disk 14 makes the complete revolution the tether will be wound around shaft 19, which attaches disk 14 to motor 18. Retrieval of currency 10*c* by pulling on the tether is thereby prevented.

Figure 6:
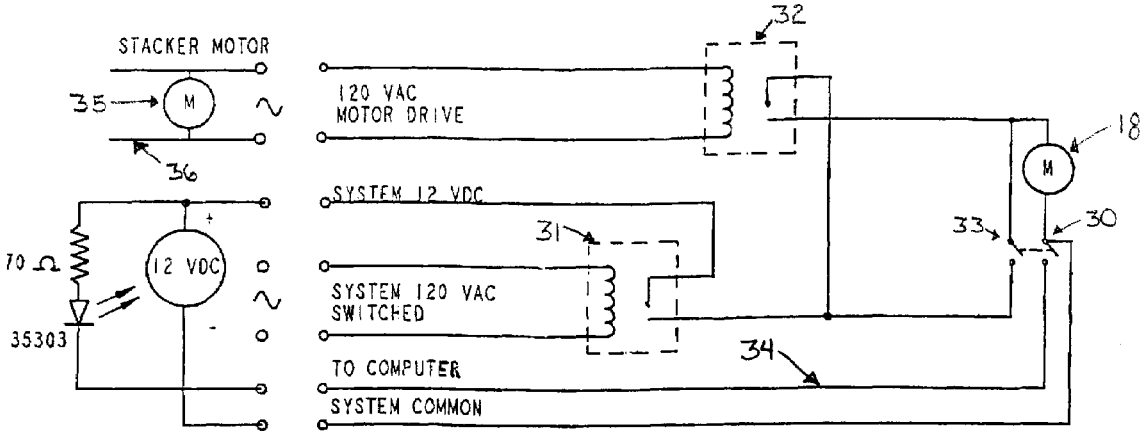
FIG. 6 is a schematic of a control system for the anti-tether apparatus.

Referring now to FIGS. 6 and 7, an existing vending machine apparatus 45 includes a system control computer 46 that can be adapted to cause disk 14 to spin and monitor its position and timing of rotation. The anti-tether apparatus 12, depicted in FIG. 7 by block diagram, communicates with system control computer 46 along line 34. As discussed above, paper currency 10*a* that is authenticated by the paper currency validator contained within the paper currency acceptor 11 is caused to exit the paper currency acceptor 11. A mechanical gate (not shown) at the exit of the paper currency acceptor is caused to lift by the exiting paper currency 10*b*. A photo sensor (not shown) detects the motion of the mechanical gate and sends a signal to the system control computer. After a brief delay, to allow time for the paper currency 10*c* to descend into the paper currency stacker 40, the system control computer sends a signal on line 36 to initiate the paper currency stacker motor 35. As long as the system control computer does not detect a fault, 120VAC power is supplied and draws in relay 31, which in turn sends 12VDC to relay 32. The initiation of the paper currency stacker motor 35 draws in relay 32 and 12VDC is supplied to disk motor 18. When power is supplied to motor 18, it rotates disk 14 such that straight edge 21 is no longer in proximity to position sensor 30. At this point, disk 14 is off of home position and both disk position sensor 30 and self-home switch 33 are put into a closed mode. Additionally, the closing of disk position sensor 30 is detected by the system control computer on line 34. Relay 32 is released when stacker motor 35 is de-energized by the system control computer. However, motor 18 remains energized through self-home switch 33 and continues to cause disk 14 to spin until straight edge 21 of disk 14 reaches disk position sensor 30. When disk position sensor 30 detects straight edge 21, disk position sensor 30 and self-home switch 33 are put into an open mode and power to motor 18 is cut.

The system control computer 46 monitors the position and duration of spinning of disk 14 by the signal sent by disk position sensor 30 on line 34. If the system control computer 46 does not detect that disk 14 returned to the home position, as when a tether causes motor 18 to stall, the system control computer 46 will not initiate the vend function. Additionally, if disk 14 is not detected as returning to home, the system control computer 46 will de-energize the 120VAC system, which will in turn release relay 31, thereby cutting the 12VDC to motor 18. If disk 14 does return to the home position, but does not do so within a predetermined time limit as monitored by the system control computer 46, the system control computer 46 will not initiate the vend function. If the disk returns to the home position within the predetermined time limit the system control computer will initiate the vend function.

The control schematic in FIG. 6 depicts a system adapted to control and monitor the disk 14 of anti-theft apparatus 12 when it is installed into an existing vending machine as an aftermarket addition. However, as is readily apparent to one of ordinary skill in the art, the disk 14 of anti-theft apparatus 12 could be controlled and monitored directly by the system control computer 46 if developed in tandem as a new product. Therefore, the disclosure of FIG. 6 is not meant to limit the scope or application of the present anti-tether apparatus.

Therefore, in summary, it can be seen that the anti-tether apparatus 12 of the present invention is located between a paper currency acceptor 11 and a paper currency stacker 40 and includes a rotatable disk 14 with slot 15 that is normally aligned with paper currency path 8. After paper currency 10*c* is passed through slot 15 of disk 14, disk 14 is caused to rotate by motor 18. The system control computer 46 of vending machine 45 monitors the position of disk 14 and the time it takes to rotate. If the system control computer 46 determines that disk 14 made at least one complete revolution within a predetermined time limit, the vend function will be initiated. However, a tether attached to paper currency 10*c* will remain in slot 15 of disk 14 after paper currency 10*c* has passed through slot 15. In this situation, the tether will prohibit the rotation of disk 14 and disk 14 may either not rotate a complete revolution because the motor stalls, or it will require a greater length of time to make the complete revolution. The system control computer 46 will detect that disk 14 did not make a complete revolution or that it required too much time to rotate and, therefore, the system control computer 46 will not initiate the vend function. If disk 14, despite the presence of a tether, is able to make at least one complete revolution within the time limit the vend function will be initiated. However, the rotation of disk 14 will cause the tether to be wound around shaft 19 of motor 18 and will prevent retrieval of paper currency 10*c* when the tether is pulled in a reverse direction.

The above is a description of the preferred embodiment. One skilled in the art will recognize that changes and modifications may be made without departing from the spirit of the disclosed invention, the scope of which is to be determined by the claims which follow and the breadth of interpretation that the law allows.

What is claimed is:

1. An anti-tether apparatus adapted for devices accepting paper currency and transporting accepted paper currency in a paper currency path, comprising:

a rotatable disk having a slot wherein paper currency is movably passed through the slot of said disk when the slot is aligned with the paper currency path; and a motor coupled to said disk for rotating said disk about an axis of rotation after paper currency has passed through the slot of said disk;

wherein the axis of rotation of said disk is substantially parallel to a direction of movement of the paper currency when said paper currency passes through the slot of said disk.

2. The apparatus of claim 1, wherein said disk rotates at least one revolution each time paper currency freely passes through the slot of said disk.

3. The apparatus of claim 1, wherein said disk is coupled to said motor by a shaft.

4. The apparatus of claim 3, wherein said disk is substantially enclosed between a front plate and a back plate.

5. The apparatus of claim 4, wherein said front plate and said back plate have currency holes substantially in alignment with the paper currency path.

6. The apparatus of claim 5, wherein said front plate is fixedly secured to said back plate.

7. The apparatus of claim 6, wherein said front plate includes an elevated portion, wherein said motor is fixedly secured to said elevated portion, and wherein said shaft passes through the area defined by said elevated portion and said disk.

8. The apparatus of claim 7, wherein material remaining in the slot of said disk after the paper currency has passed through the slot of said disk is wound around said shaft if said motor rotates said disk.

9. The apparatus of claim 4, wherein the clearances between said disk and said back plate and between said disk and said front plate are approximately equal to or smaller than the thickness of said disk.

10. The apparatus of claim 1, wherein the torque produced by said motor is sufficiently low that said motor will tend to stall when material remains in the slot of said disk when said motor rotates said disk.

11. The apparatus of claim 1, wherein the opening defined by the slot of said disk is bounded on all sides.

12. The apparatus of claim 11, wherein the opening defined by the slot of said disk encompasses both an arc substantially greater than the width of the paper currency, and a substantial portion of the radius of said disk.

13. The apparatus of claim 12, wherein said disk is substantially circular over said disk circumference.

14. A device for accepting and storing paper currency and performing a vend function, comprising:

a paper currency acceptor, wherein said paper currency acceptor includes a paper currency validator;

a paper currency stacker;

a paper currency path defined between said paper currency acceptor and said paper currency stacker;

an anti-tether apparatus, wherein said anti-tether apparatus includes a rotatable disk having a slot alignable with said paper currency path; and electronic controls for causing said disk to rotate in response to paper currency entering said paper currency stacker and for monitoring the position of said disk;

wherein said anti-tether apparatus is located between said paper currency acceptor and said paper currency stacker relative to the paper currency path, wherein the presence of a tether attached to a paper currency impedes rotation of said disk, and wherein said electronic controls detect that the rotation of said disk has been impeded by the tether.

15. The device of claim 14, wherein the axis of rotation of said disk is substantially parallel to the direction of the paper currency when said paper currency passes through the slot of said disk.

16. The device of claim 14, wherein said anti-tether apparatus includes a motor, and wherein said disk is coupled to said motor by a shaft.

17. The device of claim 16, wherein said electronic controls cause said motor to rotate said disk at least one revolution in response to a paper currency exiting said paper acceptor.

18. The device of claim 17, wherein said motor is of sufficiently low torque that a tether attached to a paper currency prevents said motor from rotating said disk.

19. The device of claim 17, wherein a tether attached to a paper currency is wound around said shaft when said motor rotates said disk.

20. The device of claim 17, wherein said electronic controls include a position sensor and a monitoring unit, said position sensor detecting if the slot of said disk is aligned with said paper currency path, and said monitoring unit detecting if said disk made at least one revolution and if said at least one revolution was completed within a preset time window.

21. The device of claim 20, wherein said electronic controls initiate a vend function when said monitoring unit detects that said disk made at least one revolution within the preset time window.

22. The device of claim 20, wherein said electronic controls do not initiate a vend function if said rotation sensor does not detect at least one revolution or said monitoring unit determines that the at least one revolution was not completed within the preset time window.

23. The device of claim 20, wherein said electronic controls send an external signal if said rotation sensor does not detect at least one revolution or said monitoring unit determines that the at least one revolution was not completed within a preset time window.

24. The device of claim 23, wherein said external signal is a notification to repair service personnel.

25. The device of claim 23, wherein said external signal is an audible alarm.

26. The device of claim 23, wherein said external signal is a notification to law enforcement personnel.

27. The device of claim 14, wherein said vend function is at least one chosen from dispensing of coins, dispensing of tokens, dispensing of product, and dispensing of a service.

28. The device of claim 27, wherein said dispensing of a service is at least one chosen from a clothes laundry function and a car wash function.

29. A method of preventing retrieval of a paper currency from a device adapted to perform a vend function, which comprises:

receiving paper currency with a paper currency acceptor; validating the authenticity of the paper currency;

transporting the paper currency along a paper currency from the paper currency acceptor, through a slotted disk, and into a paper currency stacker;

rotating the disk on an axis substantially parallel to direction of movement of paper currency along the paper currency path;

monitoring a position of the disk to determine if the disk made a complete revolution within a predetermined time limit; and initiating a vend function in response to a determination that the disk made substantially a complete revolution within the predetermined time limit.

30. A method as recited in claim 29, wherein the step of rotating the disk causes a tether attached to paper currency to be wound around a shaft.

31. A method as recited in claim 29, wherein the step of rotating the disk is inhibited by a tether attached to a paper currency.

32. A method as recited in claim 31, wherein the step of monitoring the position of the disk includes not allowing the vend function to be performed if the disk does not make a complete revolution or does not make a complete revolution within a predetermined time limit.

33. A method as recited in claim 32, including the step of sending an outside signal.

34. The method as recited in claim 29 wherein said vend function is at least one chosen from dispensing of coins, dispensing of tokens, dispensing of product and dispensing of a service.

* * * * *